US012180832B2

(12) United States Patent
Adari et al.

(10) Patent No.: US 12,180,832 B2
(45) Date of Patent: Dec. 31, 2024

(54) SLIDE AND ROTATION PROJECTION FOR REDUCING FRICTION WHILE DRILLING

(71) Applicant: Landmark Graphics Corporation, Houston, TX (US)

(72) Inventors: Rishi Adari, Katy, TX (US); Adolfo Gonzales, Houston, TX (US); Samuel Robello, Cypress, TX (US)

(73) Assignee: Landmark Graphics Corporation, Houston, TX (US)

( * ) Notice: Subject to any disclaimer, the term of this patent is extended or adjusted under 35 U.S.C. 154(b) by 292 days.

(21) Appl. No.: 17/618,650

(22) PCT Filed: Feb. 7, 2020

(86) PCT No.: PCT/US2020/017245
§ 371 (c)(1),
(2) Date: Dec. 13, 2021

(87) PCT Pub. No.: WO2021/040786
PCT Pub. Date: Mar. 4, 2021

(65) Prior Publication Data

US 2022/0298911 A1 Sep. 22, 2022

Related U.S. Application Data

(60) Provisional application No. 62/891,003, filed on Aug. 23, 2019.

(51) Int. Cl.
*E21B 7/06* (2006.01)
*E21B 4/02* (2006.01)
*E21B 44/00* (2006.01)

(52) U.S. Cl.
CPC ..... *E21B 7/06* (2013.01); *E21B 4/02* (2013.01); *E21B 44/00* (2013.01)

(58) Field of Classification Search
CPC ... E21B 44/04; E21B 4/02; E21B 7/06; E21B 47/00; E21B 44/00; E21B 41/00
See application file for complete search history.

(56) References Cited

U.S. PATENT DOCUMENTS 4,549,431 A 10/1985 Soeiinah
6,490,500 B1 12/2002 Mcculloch
(Continued)

OTHER PUBLICATIONS

Haduch et al., :Solution of Common Stuck Pipe Problems Through The Adaptation of Torque Drag Calculations, Presented at the SPE/IADS Drilling Conference, Dallas, TX (Paper 27490-MS), Feb. 15-18, 1994.

(Continued)

*Primary Examiner* — Nicole Coy
(74) *Attorney, Agent, or Firm* — Kilpatrick Townsend & Stockton LLP

(57) ABSTRACT

This disclosure relates to systems and methods for controlling a motor based on a slide-rotate ratio while drilling a wellbore. The system includes at least one sensor disposable with respect to a drillstring and a motor communicatively coupled to the drillstring. A computing device performs operations for controlling the motor based on the slide-rotate ratio. The computing receives input data corresponding to characteristics of the drillstring, the motor, or both. The computing device calculates a hook load for multiple time intervals. The computing device determines a friction factor based on the hook load for each of the time intervals. The computing device projects a slide-rotate ratio for the motor that substantially minimizes friction while operating the drill string, and controls the motor based on the slide-rotate ratio.

20 Claims, 11 Drawing Sheets

(56) References Cited

U.S. PATENT DOCUMENTS

| | | | | |
|---|---|---|---|---|
| 8,589,136 | B2 * | 11/2013 | Ertas | E21B 7/00 703/1 |
| 9,574,412 | B2 * | 2/2017 | Pham | G05D 7/0617 |
| 9,932,813 | B2 * | 4/2018 | Haq | E21B 44/00 |
| 9,938,815 | B2 * | 4/2018 | Samuel | E21B 47/022 |
| 10,914,119 | B2 * | 2/2021 | Vorhoff | E21B 47/18 |
| 2012/0024606 | A1 * | 2/2012 | Pirovolou | E21B 44/005 703/10 |
| 2014/0196949 | A1 * | 7/2014 | Hareland | E21B 44/02 175/27 |
| 2015/0361779 | A1 | 12/2015 | Haq et al. | |
| 2016/0145993 | A1 | 5/2016 | Gillan et al. | |
| 2020/0370409 | A1 * | 11/2020 | Yu | E21B 47/12 |
| 2022/0253761 | A1 * | 8/2022 | Jamieson | E21B 44/00 |
| 2022/0290550 | A1 * | 9/2022 | Ba | E21B 44/00 |
| 2022/0372861 | A1 * | 11/2022 | Wu | E21B 7/06 |

OTHER PUBLICATIONS

Johancsik et al., "Torque and Drag in Directional Wells—Prediction and Measurement", Journal of Petroleum Technology, 36(6), DOI:10.2118/11380-PA, 1984, pp. 987-992.

International Application No. PCT/US2020/017245, International Search Report and Written Opinion, mailed on Jun. 23, 2020, 10 pages.

* cited by examiner

SLIDE AND ROTATION PROJECTION FOR REDUCING FRICTION WHILE DRILLING

TECHNICAL FIELD

The present disclosure relates generally to wellbore drilling and, more particularly (although not necessarily exclusively), to determining controls for a motor for wellbore drilling.

BACKGROUND

A wellbore can be formed by drilling through a subterranean formation. The subterranean formation may include a rock matrix permeated by oil or gas that is to be extracted using the well system. During the drilling operation, a drill bit may approach or pass through various rock formation boundaries in the rock matrix. Determining the total friction on the drill bit and drillstring can be used to compute penetration rates and to plan further well drilling and completion times.

Drilling can be performed in a sliding mode or a rotating mode depending on which mode provides the safest and fastest method of drilling of the wellbore. Drilling in a sliding mode includes drilling with a mud motor without rotating the drillstring from the surface. In general, sliding may be used for directional drilling, to increase or correct hole angle as measured from a virtual vertical axis. Drilling in a rotating mode includes rotating the drillstring to progress the hole in a straight line direction relative to the mud motor position (e.g., vertical drilling or maintaining a hole angle from a previous sliding mode).

DETAILED DESCRIPTION

Figure 1:
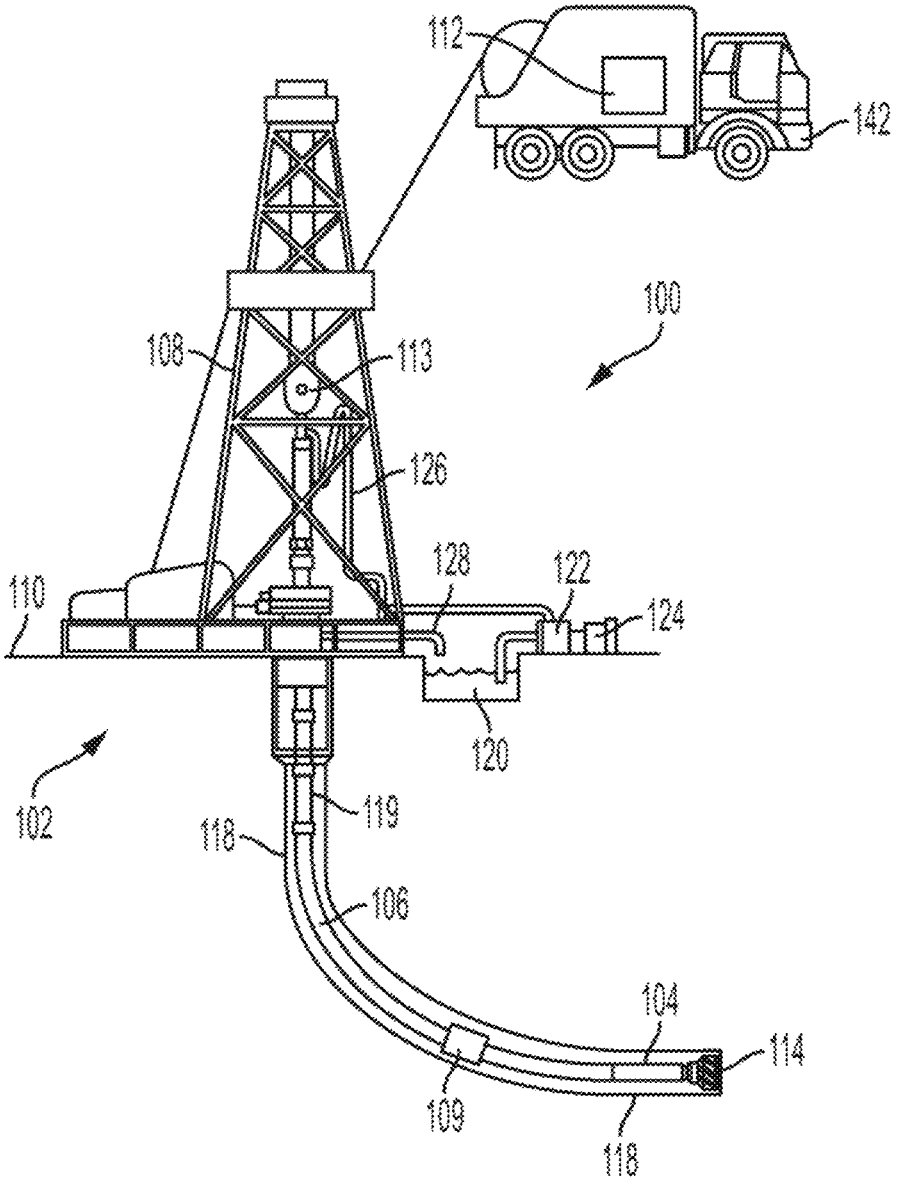
FIG. 1 depicts a cross-sectional view of an example of a drilling system that includes slide and rotation projection according to some aspects of the disclosure.

Certain aspects and features relate to projecting a slide-rotate ratio for controlling wellbore drilling operations. During a drilling operation, a mud motor and a drillstring change modes of operation to change the angle of the wellbore (i.e., directional drilling) or to address changing downhole conditions (i.e., a pressure condition, a tension change of the drillstring, temperate change, etc.). Two modes of operation include a sliding mode that drills with a mud motor without rotating the drillstring and a rotating mode that drills with the mud motor while rotating the drillstring. A computing system may provide instructions to the drilling equipment to control a ratio of modes of operation (i.e., operate in sliding mode for a first length of time, operating in rotating mode for a second length of time). The ratio of the durations of these two modes can be described as the slide-rotate ratio. The slide-rotate ratio can also be projected using a friction factor, wellbore characteristics (e.g., rock formation data), desired penetration rates and directional information. The projected slide-rotate ratio can be used to optimize drilling progression in a wellbore.

Traditional drilling techniques for managing slide and rotation (e.g., operating in sliding mode and operating in rotating mode) rely on observing data and reacting to downhole conditions. In one example, observed changes in hook load may be caused by the friction acting on the drill string. While operating in the rotating mode, the friction has negligible effect on the drillstring as the velocity of the drilling may be much lower than the velocity of the pipe rotation. During the sliding operation, since the drillstring is not rotating, the sliding rate (e.g., the rate of penetration) may exert a significant influence on the friction force. During the drilling operation, the mode can change between the sliding mode and the rotating mode. While operating in the sliding mode or the rotating mode, the hook load of the system can vary. The hook load can also vary due to mode changes. For example, during a change of modes from the sliding mode to the rotating mode, the hook load may change from a low value to high value. Observing these changes in friction force and adjusting sliding and rotation times manually may not adequately anticipate and avoid failures. For example, manual adjustment may not prevent stuck pipes, severe circulation loss, or severe pack-off.

However, projection of accurate forces and stresses may achieve a successful and safe drilling operation by preventing these types of failures. For more advanced drilling processes such as directional drilling, running casing operations, or coiled tubing operations, projection of the slide-rotate ratio enables detecting a deviance from the projected hook load and friction factors. Detecting this deviance may enable an adjustment of the slide-rotate ratio prior to a failure.

Some aspects and features use data analytics and uncertainty analysis to project a slide-rotate ratio that substantially minimizes failures as a drilling operation progresses. In some examples, a system includes at least one sensor for a drillstring in a wellbore and a mud motor communicatively coupled to a drillstring. The system also includes a computing device communicatively coupled to the sensor and the motor.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a cross-sectional view of an example of a drilling system 100 that includes slide and rotation projection according to some aspects of the disclosure. A wellbore of the type used to extract hydrocarbons from a formation may be created by drilling into the earth 102 using the drilling system 100. The drilling system 100 may be configured to drive a bottom hole assembly (BHA) 104 positioned or otherwise arranged at the bottom of a drillstring 106 extended into the earth 102 from a derrick 108 arranged at the surface 110. The derrick 108 includes a kelly 113 used to lower and raise the drillstring 106. The BHA 104 may include a drill bit 114 operatively coupled to a drillstring 106, which may be moved axially within a drilled wellbore 118 as attached to the drillstring 106. Drillstring 106 may include one or more sensors 109, for determining conditions in the wellbore. The sensors can send signals to the surface 110 via a wired or wireless connection (now shown). The combination of any support structure (in this example, derrick 108), any motors, electrical equipment, and support for the drillstring and tool string may be referred to herein as a drilling arrangement.

During operation, the drill bit 114 penetrates the earth 102 and thereby creates the wellbore 118. The BHA 104 provides control of the drill bit 114 as it advances into the earth 102. Control of the drill bit includes rotating and sliding as influenced by a motor 119, which in some examples, is a mud motor. The drillstring may also be rotated from the surface by the kelly 113. A mud motor is part of the drillstring and can use, at least in part, the hydraulic power of the drilling fluid to operate. Fluid or "mud" from a mud tank 120 may be pumped downhole using a mud pump 122 powered by an adjacent power source, such as a prime mover or motor 124. The mud may be pumped from the mud tank 120, through a stand pipe 126, which feeds the mud into the drillstring 106 and conveys the same to the drill bit 114. The mud exits one or more nozzles (not shown) arranged in the drill bit 114 and in the process, cools the drill bit 114. After exiting the drill bit 114, the mud circulates back to the surface 110 via the annulus defined between the wellbore 118 and the drillstring 106, and in the process returns the drill cuttings and debris to the surface. The cuttings and mud mixture are passed through a flow line 128 and are processed such that a cleaned mud is returned downhole through the stand pipe 126 once again.

Still referring to FIG. 1, the drilling arrangement and any sensors (through the drilling arrangement or directly) are connected to a computing device 112. In FIG. 1, the computing device 112 is illustrated as being deployed in a work vehicle 142, however, a computing device to receive data from sensors and to control drill bit 114 can be permanently installed with the drilling arrangement, be hand-held, or be remotely located. In some examples, the computing device 112 can process at least a portion of the data received and can transmit the processed or unprocessed data to another computing device (not shown) via a wired or wireless network. Either or both computing devices can perform the operations described herein for determining forces and projected ratios and applying control parameters for sliding and rotating of the mud motor or drill bit. The computing device 112 can be positioned belowground, aboveground, onsite, in a vehicle, offsite, etc. The computing device 112 can include a processing device interfaced with other hardware via a bus. A memory, which can include any suitable tangible (and non-transitory) computer-readable medium, such as RAM, ROM, EEPROM, or the like, can embody program components that configure operation of the computing device 112. A more specific example of the computing device 112 is described in greater detail below with respect to FIG. 2.

Figure 2:
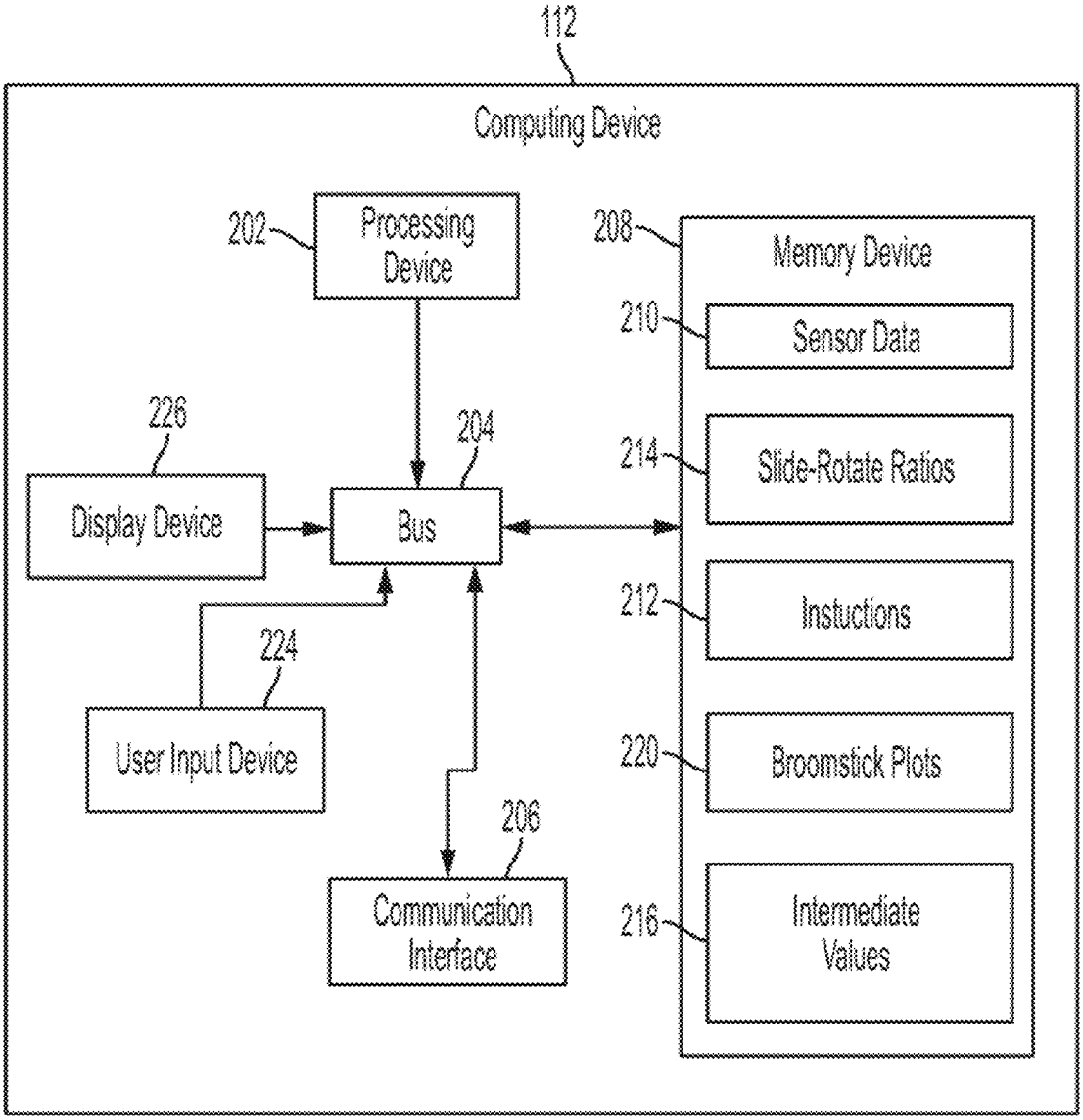
FIG. 2 depicts an example of a computing device that can be used in slide and rotation projection according to some aspects of the disclosure.

FIG. 2 depicts an example of a computing device 112 according to one example. The computing device 112 can include a processing device 202, a bus 204, a communication interface 206, a memory device 208, a user input device 224, and a display device 226. In some examples, some or all of the components shown in FIG. 2 can be integrated into a single structure, such as a single housing. In other examples, some or all of the components shown in FIG. 2 can be distributed (e.g., in separate housings) and in communication with each other.

The processing device 202 can execute one or more operations for controlling a drilling operation or displaying data and information about the drilling operations, analysis of forces on a drillstring or motor, etc. The processing device 202 can execute instructions stored in the memory device 208 to perform the operations. The processing device 202 can include one processing device or multiple processing devices. Non-limiting examples of the processing device 202 include a Field-Programmable Gate Array ("FPGA"), an application-specific integrated circuit ("ASIC"), a microprocessing device, etc.

The processing device 202 can be communicatively coupled to the memory device 208 via the bus 204. The non-volatile memory device 208 may include any type of memory device that retains stored information when powered off. Non-limiting examples of the memory device 208 include electrically erasable and programmable read-only memory ("EEPROM"), flash memory, or any other type of non-volatile memory. In some examples, at least some of the memory device 208 can include a non-transitory medium from which the processing device 202 can read instructions. A computer-readable medium can include electronic, optical, magnetic, or other storage devices capable of providing the processing device 202 with computer-readable instructions or other program code. Non-limiting examples of a computer-readable medium include (but, are not limited to) magnetic disk(s), memory chip(s), read-only memory (ROM), random-access memory ("RAM"), an ASIC, a configured processing device, optical storage, or any other medium from which a computer processing device can read instructions. The instructions can include processing device-specific instructions generated by a compiler or an interpreter from code written in any suitable computer-programming language, including, for example, C, C++, C#, etc.

In some examples, the memory device 208 can include sensor data 210, received from sensor 109 or other sensors. In some examples, the memory device 208 can include a computer program code instructions 212 for calculating hook loads, determining friction factors, and projecting slide-rotate ratios. Some or all of the results of these calculations can be stored as intermediate values 216. The memory device 208 can store the slide-rotate ratios 214 for use in controlling a mud motor. The memory device 208 can include broomstick plots 220, for display to a user.

In some examples, the computing device 112 includes a communication interface 206. The communication interface 206 can represent one or more components that facilitate a network connection or otherwise facilitate communication between electronic devices. Examples include, but are not limited to, wired interfaces such as Ethernet, USB, IEEE 1394, and/or wireless interfaces such as IEEE 802.11, Bluetooth, near-field communication (NFC) interfaces, RFID interfaces, or radio interfaces for accessing cellular telephone networks (e.g., transceiver/antenna for accessing a CDMA, GSM, UMTS, or other mobile communications network). In some examples, the computing device 112 includes a user input device 224. The user input device 224 can represent one or more components used to input data. Examples of the user input device 224 can include a keyboard, mouse, touchpad, button, or touch-screen display, etc. In some examples, the computing device 112 includes a display device 226. The display device 226 can represent one or more components used to output data. Examples of the display device 226 can include a liquid-crystal display (LCD), a computer monitor, a touch-screen display, etc. In some examples, the user input device 916 and the display device 226 can be a single device, such as a touch-screen display. The display device can be used to display broomstick plots 220.

In some aspects, in order to obtain calibrated, calculated values for a sliding and rotating the mud motor, the coefficient of friction, also called the friction factor, should be obtained. The coefficient of friction (COF) is the ratio of the frictional force Ff to the normal force Fn acting at the point of contact between the motor and the formation. In some examples, the COF μ may be computed by:

$$\mu = \frac{F_f}{F_n}.$$

The drillstring can be simultaneously rotated and tripped in or out, and the drag force can be calculated by:

$$F_d = \mu_v \times F_n \times \frac{|V_{ts}|}{|V_{rs}|}.$$

The drillstring can be simultaneously rotated and reciprocated and the torque can be calculated by:

$$T = \mu_v \times F_n \times r \times \frac{|\omega|}{|V_{rs}|}.$$

Figure 3:
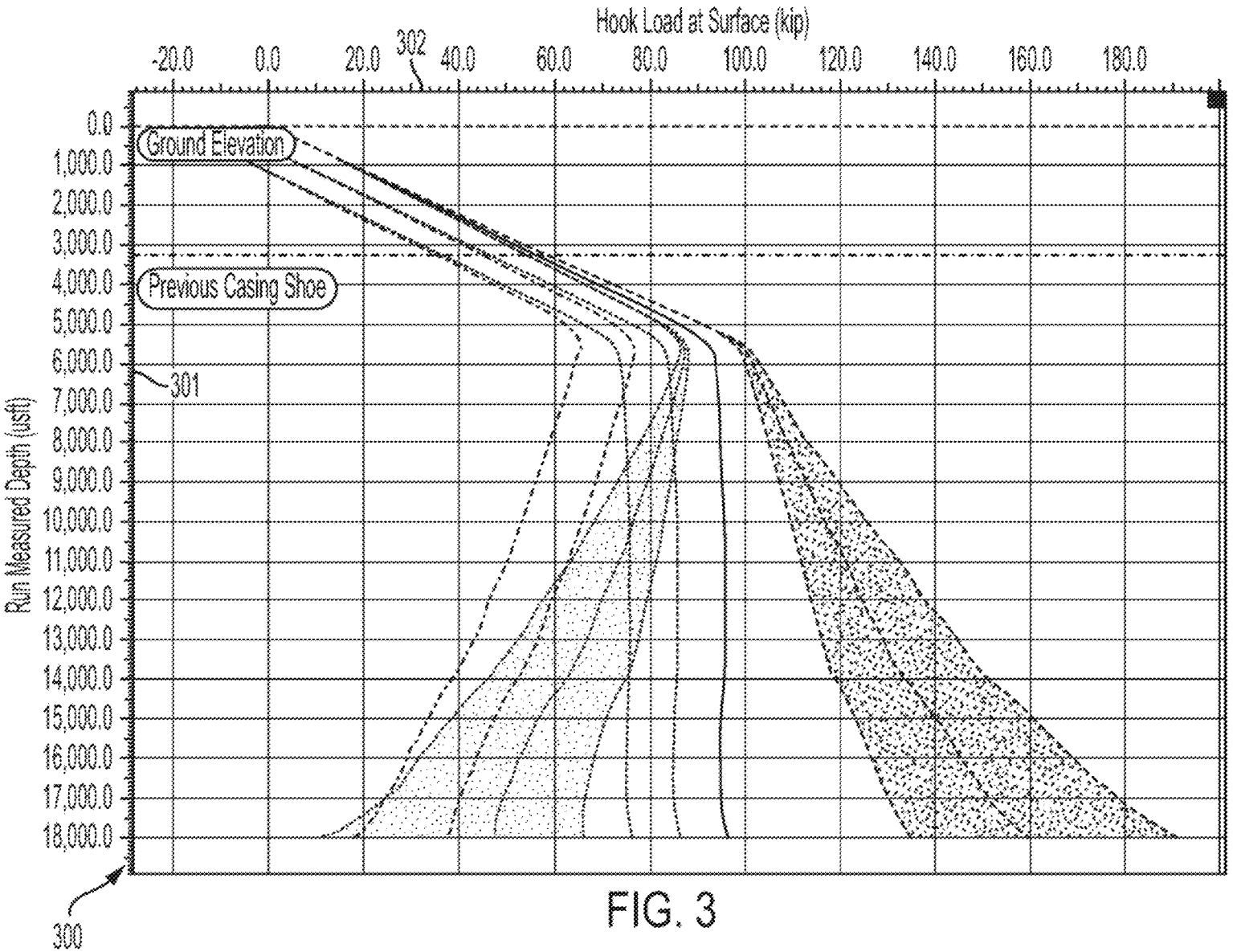
FIG. 3 depicts an example of a plot showing calculated hook loads for multiple friction factors, according to some aspects of the disclosure.

FIG. 3 depicts a plot 300 of exemplary calculated hook loads for multiple friction factors, according to some aspects of the disclosure. For instance, FIG. 3 shows a plot of the hook load calculations for various friction factors (0.2 to 0.35 in open hole) for tripping and tripping out operations at various measured depths 301 and hook loads 302 at the surface. In between the rotating and sliding operations, hook loads are shown (extreme left). It can be seen that the hook load varies depending on the operation as a result of the varying friction force acting on the drill string.

Figure 4:
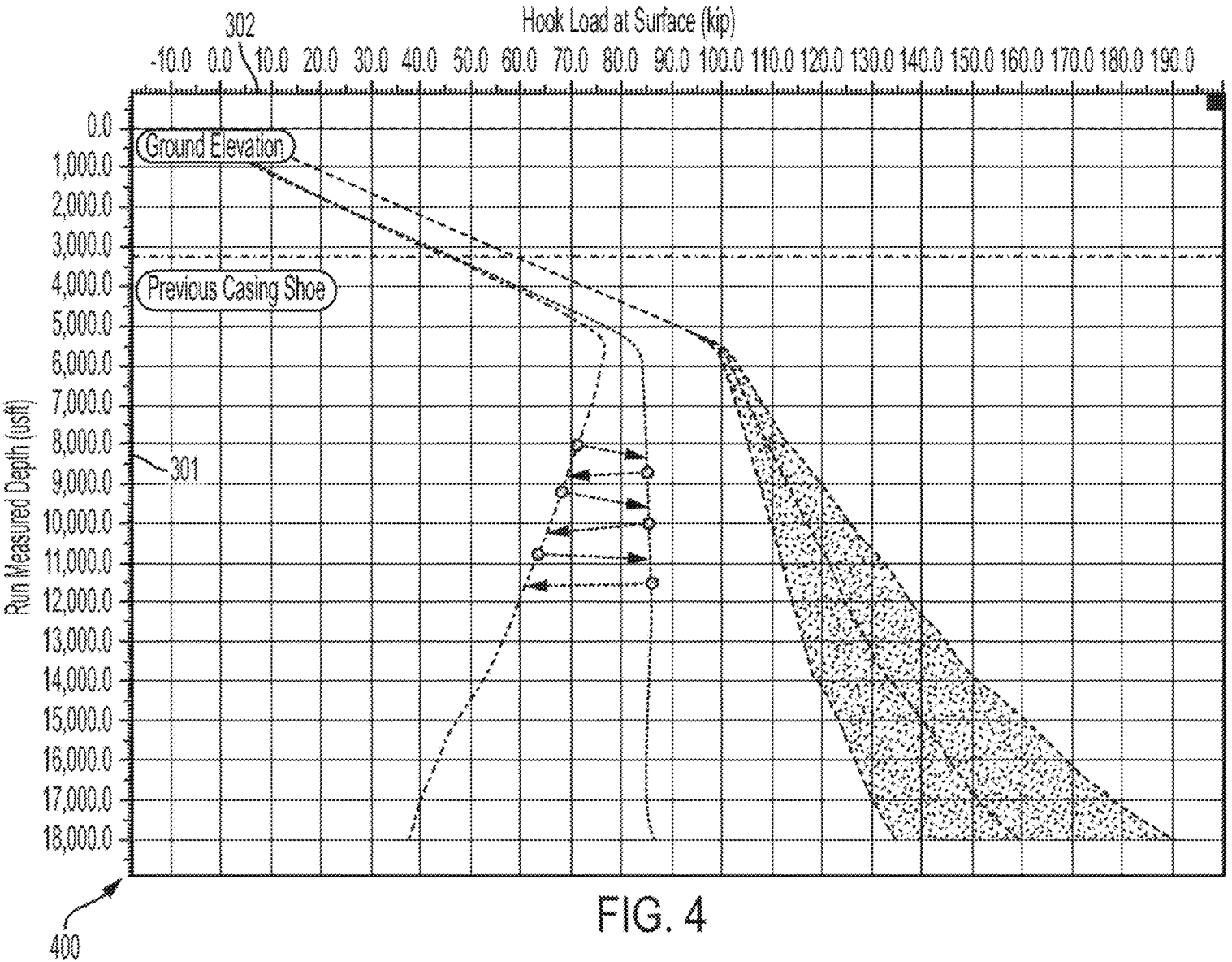
FIG. 4 depicts an example of a plot of calculated hook loads for a projected well path and a uniform slide and rotation ratio such that the actual hook load follows the projected hook load, according to some aspects of the disclosure.

When the motor is used, alternatively sliding and rotating motions are carried out at a certain ratio of time, one to the other, or certain length of a stand to maintain the friction at as close to a minimum level as possible. The ratio can be expressed as a percentage. During this process, the wellbore becomes highly undulated, as during the sliding operation, the well profile conforms more closely to the minimum curvature and during rotating mode the well profile conforms more closely to the radius of curvature. If the slide-rotate ratio is uniform, the actual hook load follows the hook load based on the planned well path as shown in the plot of calculated hook loads for a projected well path and a uniform slide-rotate ratio illustrated in plot 400 of FIG. 4.

Figure 5:
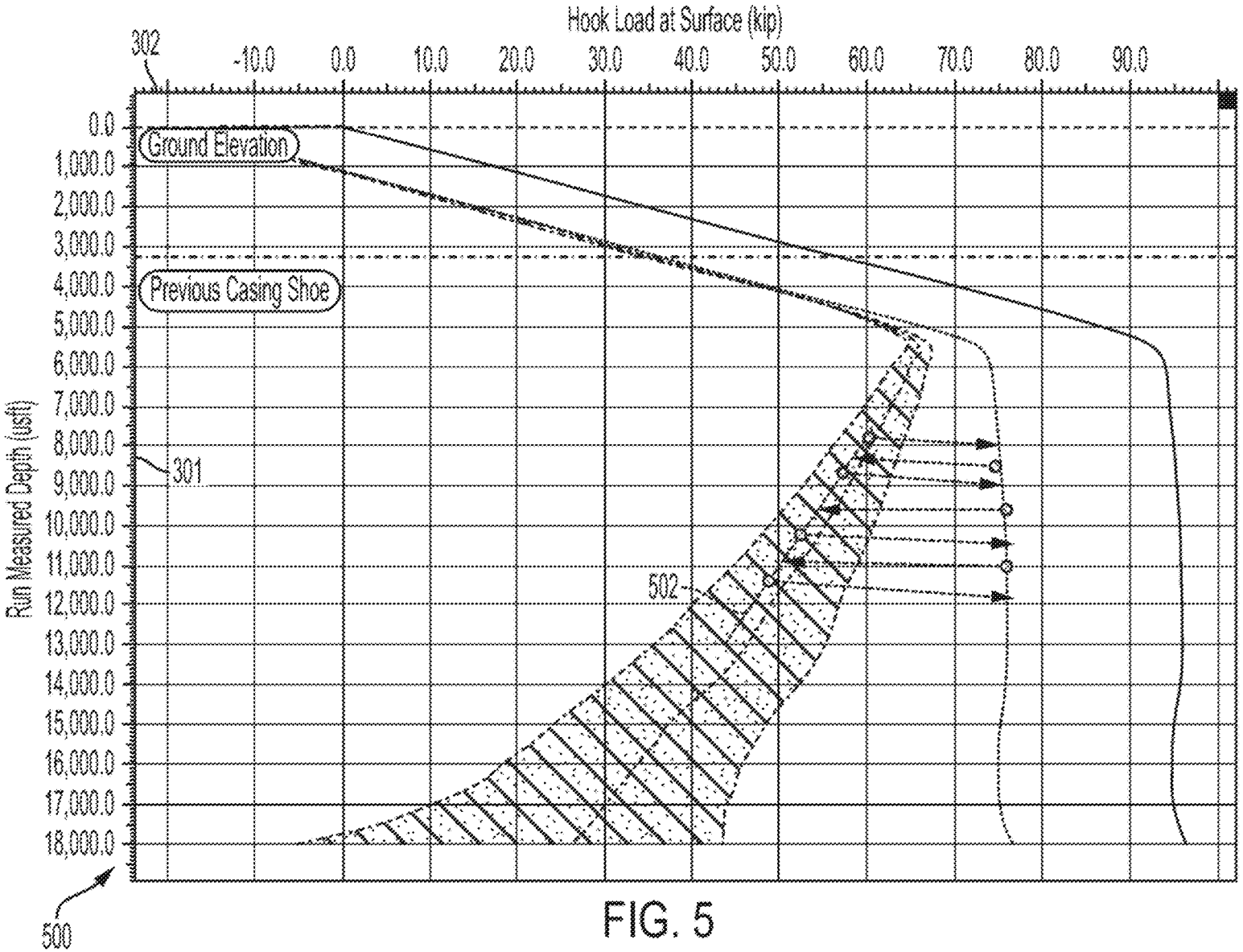
FIG. 5 depicts an example of a hook load plot that illustrates a deviation of the actual hook load from the planned hook load, according to some aspects of the disclosure.

FIG. 5 depicts an example of a hook load plot 500 that illustrates a deviation of the actual hook load from the projected hook load, according to some aspects of the disclosure. If there is a problem in the wellbore during the sliding mode, it will manifest in the hook load plot as shown in FIG. 5. In FIG. 5, it can be seen that the friction force 502 is increasing during the sliding mode while it remains constant during the rotating mode. This difference may be due to various conditions, for example, formation of ledges, increased undulation and thereby increased tortuosity, poor downhole cleaning with high cuttings bed, severe pack-off, severe loss of circulation, or erratic torque and drag response. These conditions, if allowed to continue, may lead to drilling problems such as stuck pipe or near stuck pipe incidents.

Figure 6:
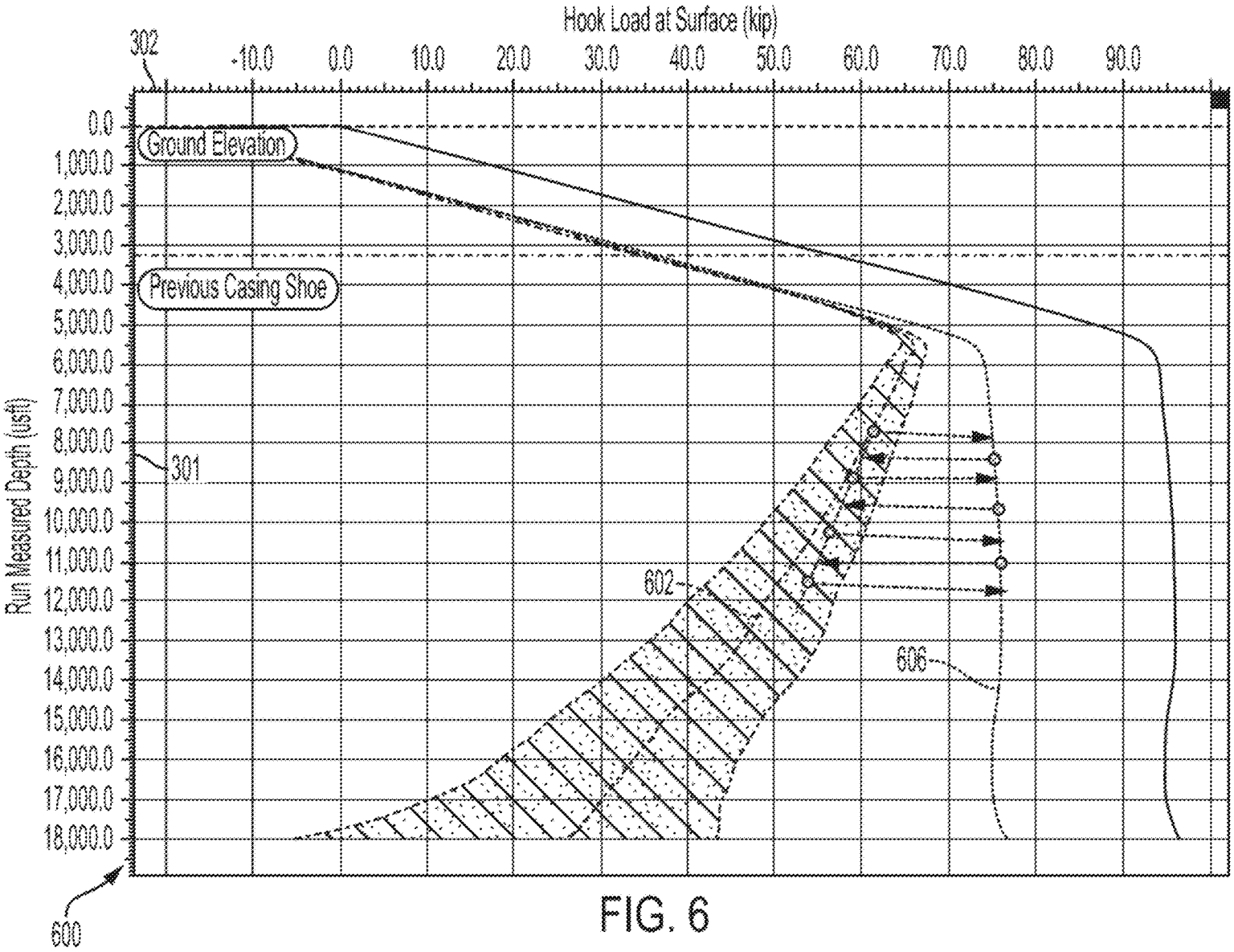
FIG. 6 depicts a curve plotted for an actual hook load increasing as compared to the projected hook load curve, according to some aspects of the disclosure.
Figure 7:
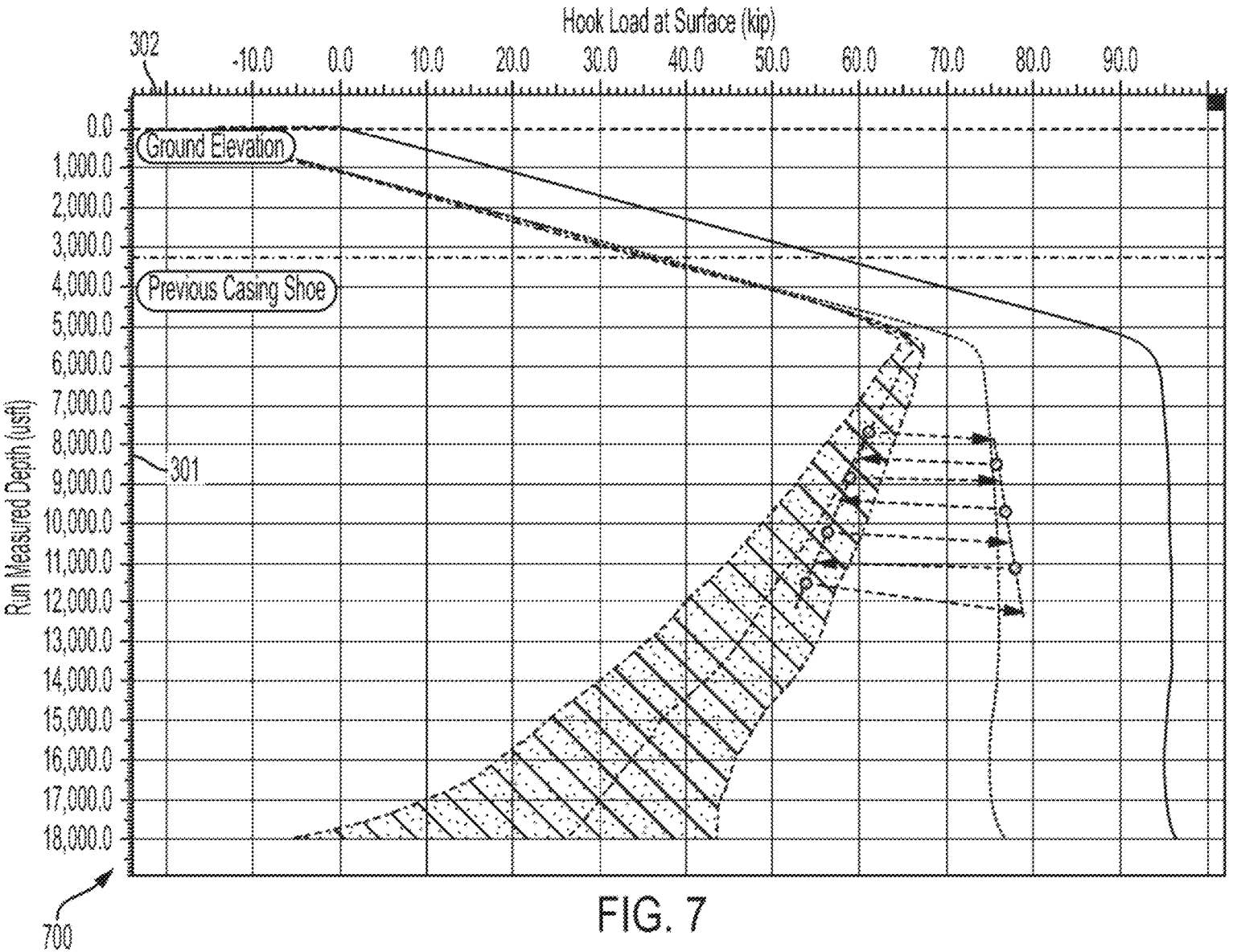
FIG. 7 depicts an example of a hook load plot that indicates that the downhole condition may be improving during a sliding mode, but degrading during rotating mode, according to some aspects of the disclosure.
Figure 8:
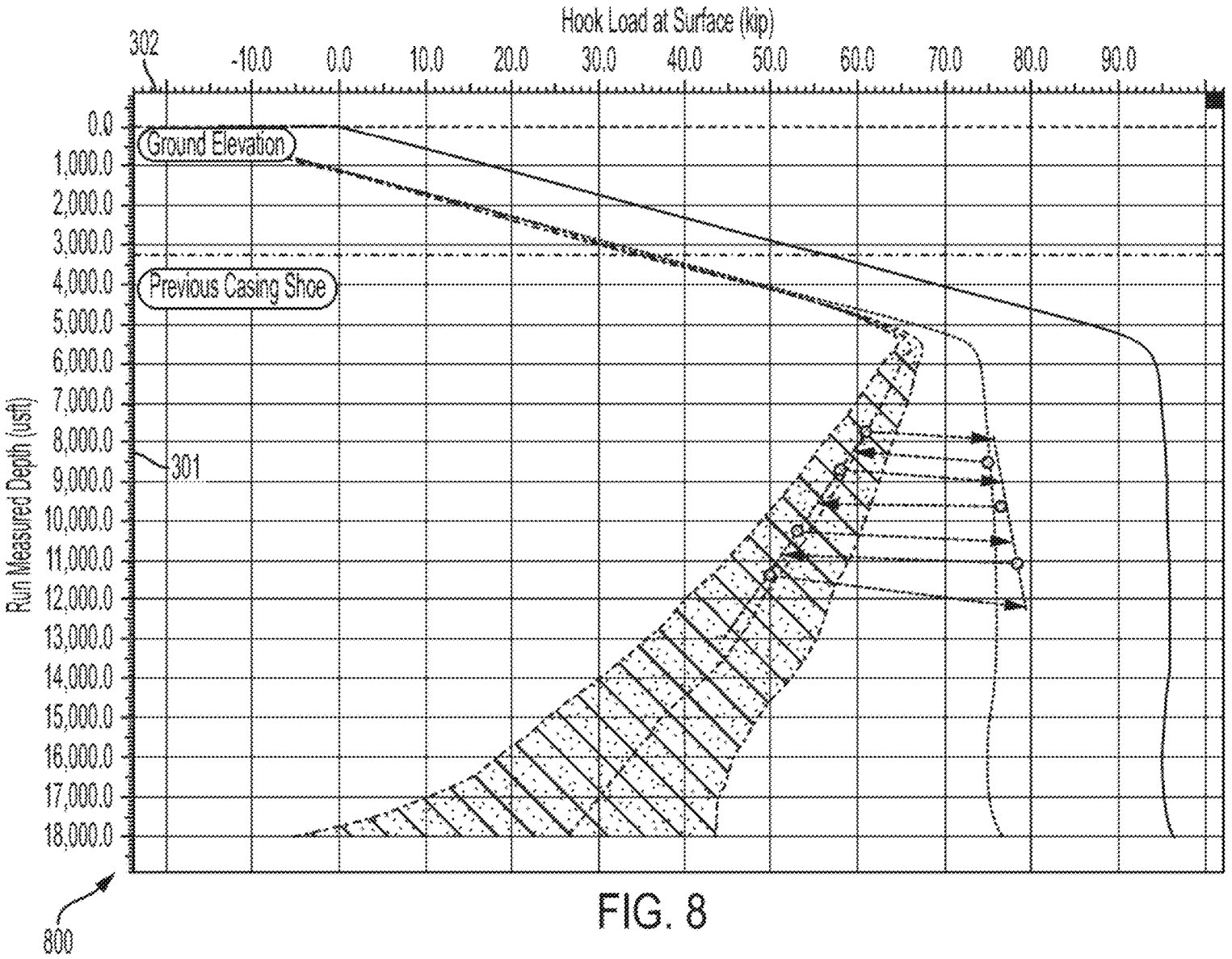
FIG. 8 depicts an example of a hook load plot that indicates that the downhole condition is degrading during both modes of operation according to some aspects of the disclosure.

There may be another condition in which, during sliding, the hook load may be increasing and thus the actual hook load curve is plotted to the left of the planned hook load curve as shown in FIG. 6. FIG. 6 shows plot 600 including an actual hook load curve 606 and a projected hook load curve 602. In the example of FIG. 6, the actual hook load curve 606 includes measurements in either (or both) of a rotating mode and a sliding mode. The example of FIG. 6 also includes projected curves for the rotating mode. he difference may be due to increased downhole quality and reduced cuttings pack-off, vibration, tortuosity and ledges, wellbore dogleg, energy, keyseat and side loading calculations, etc. There may other situations where the downhole condition improves during sliding mode, but gets worse during rotating mode as shown by plot 700 in FIG. 7. In still other situations, the downhole condition may be getting worse during both modes of operation as shown in plot 800 of FIG. 8. An adverse downhole condition may be indicated whenever a measured friction factor deviates from a projected friction factor by an amount equal to or greater than a threshold.

Figure 9:
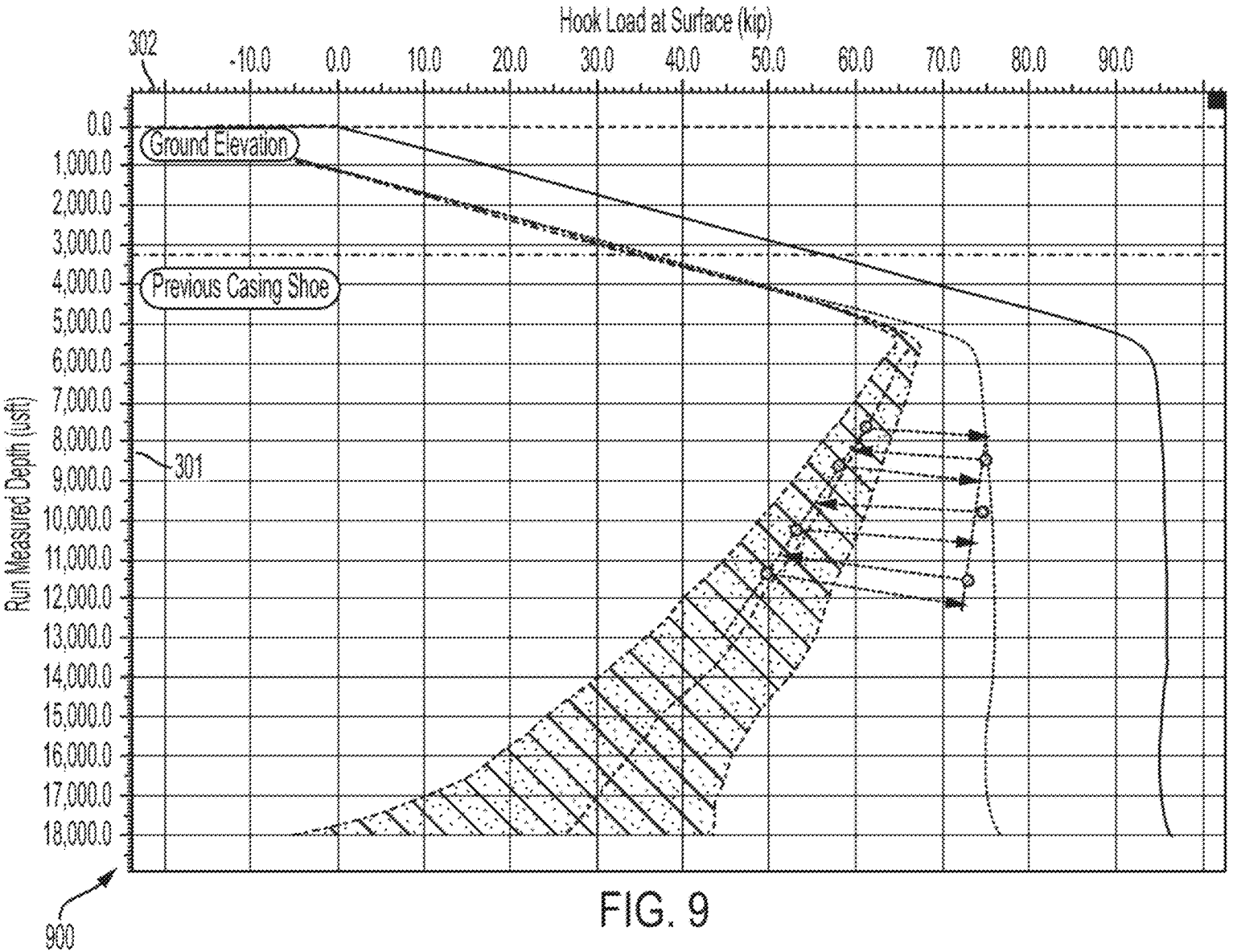
FIG. 9 depicts a hook load plot that indicates that the downhole condition may be degrading during a sliding mode, but improving during a rotating mode, according to some aspects of the disclosure.

The downhole condition alternatively may be getting worse during sliding mode, but getting better during rotating mode as shown in plot 900 of FIG. 9. Based on the hook load plot and the projection of the current friction factor, a projected friction factor can be reverse calculated and the forward slide-rotate ratio required to minimize friction and thus avoid further problems can be determined. In some examples, the ratio is calculated and expressed or displayed as a percentage. The appropriate slide-rotate ratio also helps to optimize the slide sheet based on the wellbore friction and the wellbore quality.

Figure 10:
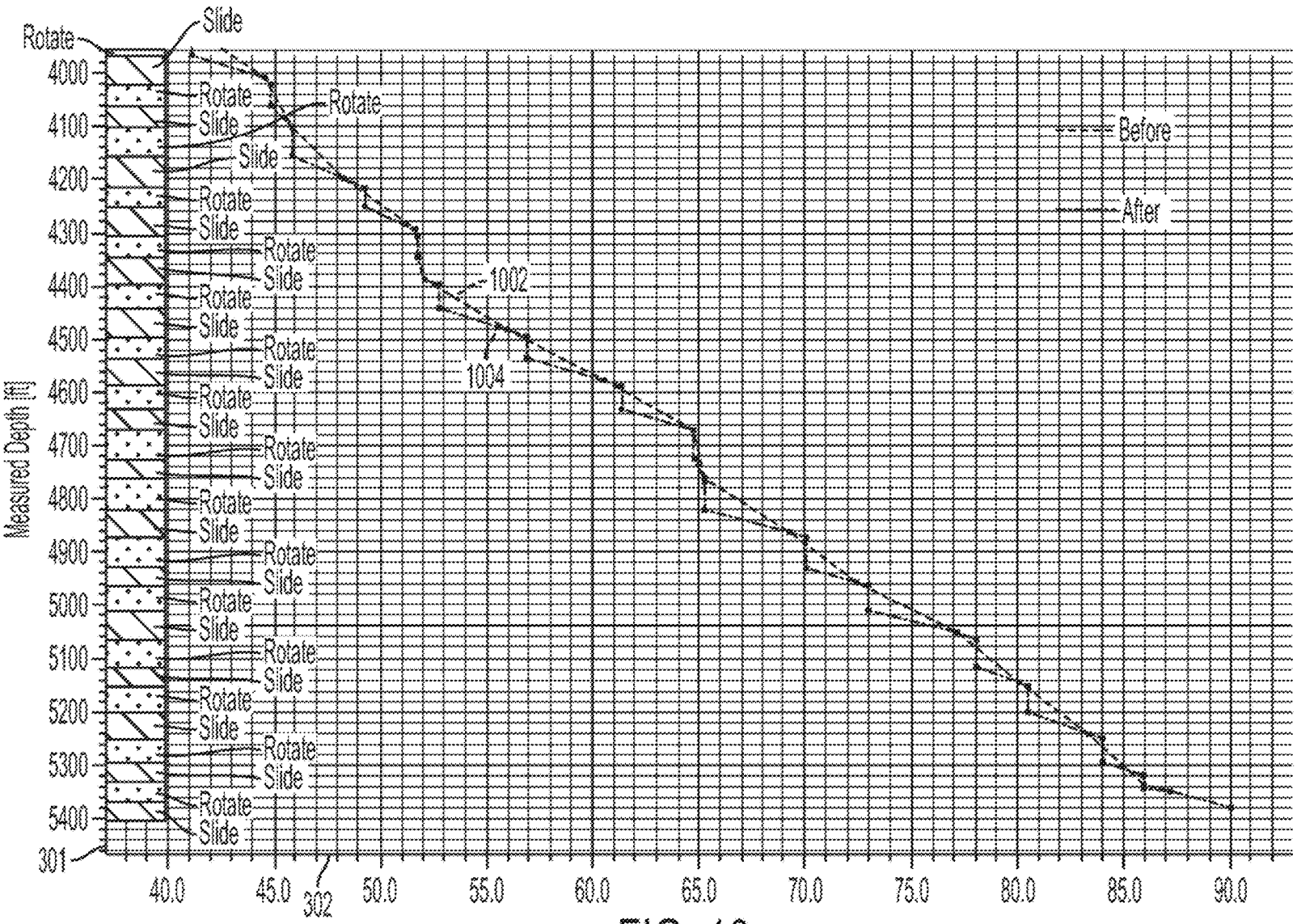
FIG. 10 depicts an example of slide-rotate curves for a mud motor, according to aspects of this disclosure.

FIG. 10 shows a plot 1000 of slide-rotate curves for a typical mud motor. The before curve 1002 is a projected ideal slide-rotate curve according to aspects of this disclosure. The after curve 1004 is the achieved slide-rotate curve in actual use, through which friction is kept within acceptable limits.

Figure 11:
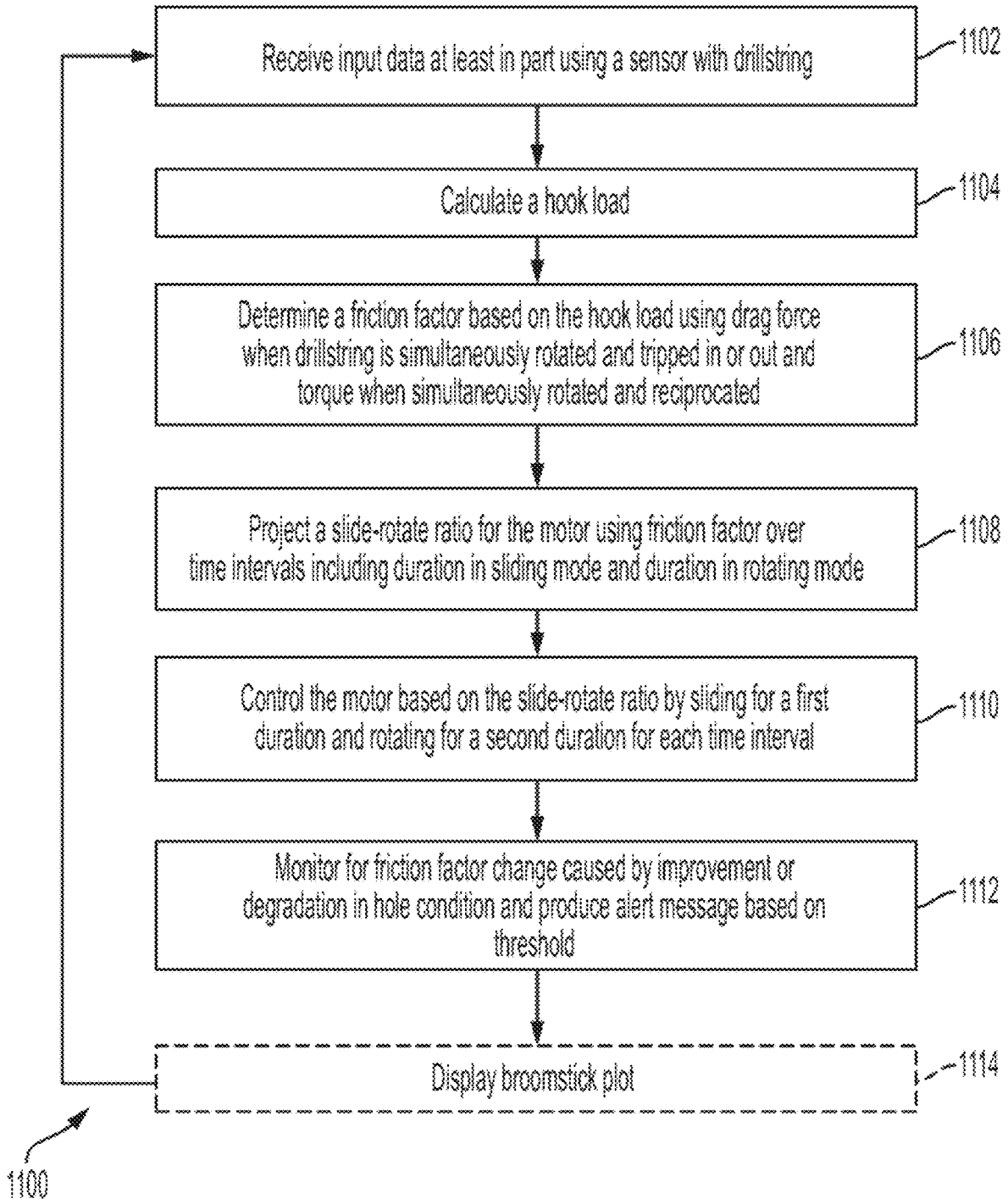
FIG. 11 depicts a process for controlling a motor based on a slide-rotate ratio, according to the present disclosure.

FIG. 11 depicts a process 1100 for controlling a drillstring and mud motor based on a slide-rotate ratio, according aspects of the present disclosure. For example, processing device 202 of the computing device 112 may control a mode of operation or speed of operation for the mud motor, the drillstring, or both based on computing slide-rotate ratios.

At block 1102, processing device 202 receives input data at least in part by using a sensor. For example, the computing device 112 may receive information transmitted from a downhole sensor. In some aspects, the downhole sensor can include one or more downhole devices on the drill string including torque sensors, vibration sensors, acoustic sensors, electromagnetic sensors, or the like. The computing device 112 may receive the information via the communication interface 206, which can be a wired or wireless communication interface. In some examples, the information received from the downhole sensor is stored in memory device 208 as sensor data 210.

At block 1104, processing device 202 calculates a hook load. For example, the processing device 202 may compute a hook load for planned conditions or real-time measured conditions. The processing device 202 may calculate the hook load by executing instructions 212.

At block 1106, processing device 202 determine a friction factor based on the hook load. The processing device 202 computes a friction factor by calculating the ratio of the frictional force to the normal force acting at the point of contact. The processing device 202 may compute the friction factor from measured or projected data. In some cases, multiple friction factors may be computed for various downhole conditions or modes of drilling (e.g., a friction factor for sliding or rotating).

At block 1108, processing device 202 determines a slide-rotate ratio for the mud motor. For example, the processing device 202 may compute a slide-rotate ratio based on the friction factor, calculated hook load, and other information received from downhole sensors. The processing device 202 can determine the ratio of time or distance that the motor should operate in a sliding mode and a rotating mode to optimize rate of penetration of the drillstring while minimizing friction. This determination can include estimating a first duration of operating the drillstring in a sliding mode and estimating a second duration of operating the drillstring in a rotating mode in order to substantially minimizes a total friction on the drillstring. In one example, the computing device 112 can display this information and the measured friction as a broomstick plot, such as illustrated in FIGS. 3-10.

At block 1110, computing device 112 controls the drillstring and mud motor based on a selected slide-rotate ratio. For example, the computing device 112 may control operations of the motor 119 based on the slide-rotate ratio using connections to the motor through communication interface 206. For example, processing device 202 may compute that a particular slide-rotate ratio (e.g., as illustrated by the slide-rotate ratios of the broomstick plots in FIGS. 3-10) minimizes the friction for a wellbore. The processing device 202 can also identify deviations of the measured friction from the planned friction factor and classify the deviation as an improving or degrading downhole condition, or an adverse downhole condition. For instance, the processing device 202 may determine that the actual friction factors exhibit an increasing trend as compared to the planned friction factor (e.g., in either the rotating mode or the sliding mode of operation) and that the increase in friction is caused by a degradation of drilling conditions downhole. In another example, the processing device 202 may determine that the actual friction factors exhibit a decreasing trend as compared to the planned friction factor and that the decrease in friction is an improvement of drilling conditions downhole. The computing device 112 may also compare deviations with one or more threshold vales. The various threshold values may be preset by the equipment manufacturer, customizable by the operator, or variable based on the drilling conditions, particular wellbore plan, and detected conditions downhole.

In some examples, the processing device 202 can adjust the slide-rotate ratio in response to determining a trend of the friction factor indicating a degrading drilling condition of the drillstring downhole. For instance, the computing device 112 can adjust the motor through communication interface 206 to increase or decrease the duration or distance that the motor is operating in the slide or rotate modes. The computing device 112 can also provide automated control of the motor and drillstring to minimize the friction of drilling in both modes by monitoring the measured friction factors compared to the planned friction factors. The computing device can control the motor by activating a slide mode for a first duration of time and activating a rotating mode for a second duration of time.

At block 1112, computing device 112 monitors for a change in the friction factor caused by an improvement or a degradation in downhole condition and produces an alert message based on various threshold values. For example, the processing device 202 can also identify deviations of the measured friction factor from the planned friction factor and determine a magnitude and direction of deviation. For instance, the processing device 202 may determine that the actual friction factors exhibit a trend as compared to the planned friction factors (e.g., in either the rotating or sliding mode of operation or both) and that the trend in friction factor is caused by a degradation or improvement of drilling conditions of the drillstring downhole. The computing device 112 may determine a magnitude of the deviation between the actual friction factors and the planned friction factors. The computing device 112 may compare the magnitudes with one or more threshold vales. The various threshold values may be preset by the equipment manufacturer, customizable by the operator, or variable based on the drilling conditions, particular wellbore plan, and detected conditions downhole. Based on the comparison of the magnitude and the respective threshold, the computing device 112 may generate an alert message to notify the operator of a changing condition downhole.

At block 1114, the computing device 112 displays a broomstick blot to the operator. For instance, computing device 112 may display broomstick plots as described with regards to FIGS. 3-9 using a presentation device or remote display device. The process 1100 may be terminated at the display of the broomstick plot, or in some cases, may return to block 1102 to execute an additional computation to generate an updated broomstick plot.

In some aspects, a system for providing a slide-rotate ratio projection is provided according to one or more of the following examples:

[Paragraph versions of the claims to be added here after inventor approval of the claims.]

The foregoing description of the examples, including illustrated examples, has been presented only for the purpose of illustration and description and is not intended to be exhaustive or to limit the subject matter to the precise forms disclosed. Numerous modifications, combinations, adaptations, uses, and installations thereof can be apparent to those skilled in the art without departing from the scope of this disclosure. The illustrative examples described above are given to introduce the reader to the general subject matter discussed here and are not intended to limit the scope of the disclosed concepts.

What is claimed is:

1. A system comprising:

at least one sensor disposable with respect to a drillstring in a wellbore;

a motor communicatively coupled to a drillstring;

a processor communicatively coupled to the sensor and the motor; and a non-transitory memory device comprising instructions that are executable by the processor to cause the processor to perform operations comprising:

receiving input data from the sensor, the input data corresponding to characteristics of at least one of the drillstring or the motor;

determining a plurality of hook loads from the input data for a plurality of time intervals;

determining a plurality of friction factors based on the plurality of hook loads for the plurality of time intervals;

projecting, using the plurality of friction factors for the plurality of time intervals, a slide-rotate ratio for the motor, the slide-rotate ratio including a ratio of a first duration in a slide mode of the motor to a second duration in a rotate mode of the motor; and controlling a drilling operation using the drillstring and the motor by adjusting the first duration and the second duration to satisfy the slide-rotate ratio.

2. The system of claim 1 wherein the operations further comprise displaying a broomstick plot that includes the projected slide-rotate ratio, a measured rotating mode friction factor and a measured sliding mode friction factor.

3. The system of claim 1 wherein the operations further comprise:

determining that a measured friction factor deviates from a projected friction factor due to an improvement in downhole condition or a degradation in downhole condition; and displaying an alert message when the measured friction factor is different from the projected friction factor by a threshold deviation.

4. The system of claim 3 wherein the operations further comprise identifying an adverse downhole condition based on a change in the measured friction factor as compared to the projected friction factor.

5. The system of claim 1 wherein controlling at least one of the drillstring or the motor based on the slide-rotate ratio comprises activating the slide mode for a third duration and activating the rotate mode for a sixth duration.

6. The system of claim 1 wherein projecting the slide-rotate ratio further comprises estimating the first duration of operating in the slide mode and estimating the second duration of operating in the rotate mode, wherein the first duration and the second duration substantially minimizes a total friction on the drillstring.

7. The system of claim 1 wherein determining the friction factor further comprises:

calculating a drag force corresponding to the drillstring being simultaneously rotated and tripped in or out; and calculating a torque corresponding to the drillstring being simultaneously rotated and reciprocated.

8. A method for controlling a motor during a drilling operation for a wellbore, the method comprising:

receiving input data from a sensor, the input data corresponding to characteristics of at least one of a drillstring or a motor;

determining a plurality of hook loads from the input data for a plurality of time intervals;

determining a plurality of friction factors based on the plurality of hook loads for the plurality of time intervals;

projecting, using the plurality of friction factors for the plurality of time intervals, a slide-rotate ratio for the motor, the slide-rotate ratio including a ratio of a first duration in a slide mode of the motor to a second duration in a rotate mode of the motor; and controlling a drilling operation using the drillstring and the motor by adjusting the first duration and the second duration to satisfy the slide-rotate ratio.

9. The method of claim 8 further comprising displaying a broomstick plot of at least one of the hook load, the friction factor, or the slide-rotate ratio.

10. The method of claim 8 further comprising:

determining that a measured friction factor deviates from a projected friction factor due to an improvement in downhole condition or a degradation in downhole condition; and displaying an alert message when the measured friction factor is different from the projected friction factor by a threshold deviation.

11. The method of claim 10 further comprising identifying an adverse downhole condition based on a change in the measured friction factor as compared to the projected friction factor.

12. The method of claim 8 wherein controlling the motor based on the slide-rotate ratio comprises activating the slide mode of the motor for a third duration and activating the rotate mode of the motor for a fourth duration.

13. The method of claim 8 wherein the projecting, using the friction factor over the plurality of time intervals, a slide-rotate ratio comprises estimating the first duration of operating the drillstring in the slide mode and estimating the second duration of operating the drillstring in the rotate mode, wherein the estimating the first duration and the second duration minimizes a total friction on the drillstring.

14. The method of claim 8 wherein determining the friction factor further comprises:

calculating a drag force corresponding to the drillstring being simultaneously rotated and tripped in or out; and calculating a torque corresponding to the drillstring being simultaneously rotated and reciprocated.

15. A non-transitory computer-readable medium that includes instructions that are executable by a processing device for causing the processing device to perform operations related to providing slide and rotation projection, the operations comprising:

receiving input data from a sensor, the input data corresponding to characteristics of at least one of a drillstring or a motor;

determining a plurality of hook loads from the input data for a plurality of time intervals;

determining a plurality of friction factors based on the plurality of hook loads for the plurality of time intervals;

projecting, using the plurality of friction factors for the plurality of time intervals, a slide-rotate ratio for the motor, the slide-rotate ratio including a ratio of a first duration in a slide mode of the motor to a second duration in a rotate mode of the motor; and controlling a drilling operation using the drillstring and the motor by adjusting the first duration and the second duration to satisfy the slide-rotate ratio.

16. The non-transitory computer-readable medium of claim 15 wherein the operations further comprise displaying a broomstick plot of at least one of the hook load, the friction factor, or the slide-rotate ratio.

17. The non-transitory computer-readable medium of claim 15 wherein the operations further comprise:

determining that a measured friction factor deviates from a projected friction factor due to an improvement in downhole condition or a degradation in downhole condition; and displaying an alert message when the measured friction factor is different from the projected friction factor by a threshold deviation.

18. The non-transitory computer-readable medium of claim 15 wherein controlling the motor based on the slide-rotate ratio comprises activating the slide mode of the motor for a third duration and activating the rotate mode of the motor for a fourth duration.

19. The non-transitory computer-readable medium of claim 15 wherein projecting the slide-rotate ratio further comprises estimating the first duration of operating the drillstring in the slide mode and estimating the second duration of operating the drillstring in the rotate mode, wherein the first duration and the second duration substantially minimizes a total friction on the drillstring.

20. The non-transitory computer-readable medium of claim 15 wherein determining the friction factor further comprises:

calculating a drag force corresponding to the drillstring being simultaneously rotated and tripped in or out; and calculating a torque corresponding to the drillstring being simultaneously rotated and reciprocated.

* * * * *